US006213416B1

(12) United States Patent
Luke

(10) Patent No.: US 6,213,416 B1
(45) Date of Patent: Apr. 10, 2001

(54) TREATMENT OF PHOSPHATE-CONTAINING ROCK

(75) Inventor: Donald A. Luke, Valrico, FL (US)

(73) Assignee: Ciba Specialty Chemicals Water Treatments Ltd., Bradford (GB)

( * ) Notice: Subject to any disclaimer, the term of this patent is extended or adjusted under 35 U.S.C. 154(b) by 0 days.

(21) Appl. No.: 09/401,381

(22) Filed: Sep. 22, 1999

Related U.S. Application Data

(60) Provisional application No. 60/102,040, filed on Sep. 28, 1998.

(51) Int. Cl.[7] ..... B02C 19/12
(52) U.S. Cl. ..... 241/22
(58) Field of Search ..... 241/16, 22; 423/18, 423/20

(56) References Cited

U.S. PATENT DOCUMENTS 3,852,403 * 12/1974 Booth ..... 423/18
3,868,243 2/1975 MacDonald .
4,309,222 1/1982 Hoyt .
5,183,211 * 2/1993 Malito et al. ..... 241/16

FOREIGN PATENT DOCUMENTS 0 101 253 3/1983 (EP) .
0 195 550 9/1986 (EP) .
0 213 799 3/1987 (EP) .
0 277 017 8/1988 (EP) .
0 277 018 8/1988 (EP) .
0 095 091 3/1999 (EP) .

* cited by examiner

*Primary Examiner*—Mark Rosenbaum
(74) *Attorney, Agent, or Firm*—David R. Crichton

(57) ABSTRACT

A process for improving grinding of phosphate rock comprising providing phosphate-containing rock in a form which contains from 3 to 25 wt % water, transferring the phosphate-containing rock to a grinding apparatus during a transfer stage, and grinding the phosphate-containing rock in grinding apparatus, wherein the process comprises mixing with the phosphate-containing rock during or before the transfer stage particles of water-swellable, water-insoluble polymeric material, whereby the flowability of the rock into the grinding apparatus is improved.

7 Claims, No Drawings

TREATMENT OF PHOSPHATE-CONTAINING ROCK

This application claims the benefit under 35 U.S.C. 119(e) of U.S. Provisional Application No. 60/102,040, Filed Sep. 28, 1998.

BACKGROUND TO THE INVENTION

The present invention relates to treatment of phosphate-containing rock in processes which involve a grinding stage and in particular relates to improvement of the materials handling characteristics of the phosphate-containing rock.

It is well known that phosphate-containing rock (often referred to simply as "phosphate rock") can be used to produce various materials containing phosphorus. The phosphate rock which is to be treated to produce a final product is generally obtained by first mining the rock, then pre-treating it by means of a series of flotation and physical separation stages. For many processes the rock has traditionally been additionally pre-treated in a fluidised bed drier.

These pre-treatment stages may take place before the phosphate rock is transported to the processing plant, in which the treatment process to produce the final product is to take place. Alternatively one or more of the pre-treatment stages may take place at the processing plant after transportation. The pre-treated rock is then transferred, within the processing plant, to the treatment stages. In various known processes, a grinding stage is included. One such process is the production of granular triple super phosphate (GTSP), in which phosphate rock is ground and added to hot phosphoric acid.

Use of the fluid bed drier pre-treatment stage adds expense to a process and it has of late been felt to be economically desirable to avoid this stage and instead to use phosphate rock which has not been subjected to a fluid bed drying stage. Such rock is often described as "raw" (or "wet") phosphate rock.

However, it has also been found that use of raw phosphate rock in processes which comprise a grinding stage can lead to serious problems. In particular, the materials handling properties of the raw phosphate rock can be highly inconsistent. For the operation of grinding apparatus of the type commonly in place in many processing plants it is most important that the flow of the phosphate rock to the grinding apparatus is steady and consistent. If flow is inconsistent then the apparatus, which is designed to operate continuously, is forced to operate for certain periods of time in the absence of rock. This is a serious problem and leads to excessive wear on the grinding surfaces. This greatly increases the maintenance cost of the grinding apparatus. The poor properties of the raw phosphate rock which give rise to such problems also lead to significant production losses.

It is an object of the invention to improve the efficiency of processes in which raw phosphate rock is subjected to a grinding stage. In particular it is an object of the invention to improve the properties of the raw phosphate rock.

SUMMARY OF THE INVENTION

We believe that these problems can be attributed at least partially to the presence of water and contaminants in the raw phosphate rock supplied to the processing plant. We have also found that the materials handling properties of the raw phosphate rock can be improved dramatically by the addition of water-absorbent, water-insoluble, water-swellable polymer to the rock.

According to the invention we provide a process of treating phosphate-containing rock by grinding, the process comprising (a) providing phosphate-containing rock which contains from 3 to 25 wt % water, (b) transferring the phosphate-containing rock to a grinding apparatus during a transfer stage, and (c) grinding the phosphate-containing rock in grinding apparatus, wherein the process comprises mixing particles of water-swellable, water-insoluble polymeric material, with the phosphate-containing rock before or during the transfer stage whereby the flowability of the rock into the grinding apparatus is improved.

The advantages of the invention include the fact that plant apparatus designed for treatment of phosphate rock which has been pretreated by a drying stage such as fluid-bed drying can be used for treating raw phosphate rock without modification of the apparatus.

We find surprisingly that the addition of the superabsorbent polymer has a significant effect on the materials handling properties of the raw phosphate rock. We find this particularly surprising in view of the fact that we have also found that traditional viscosity modifiers and dispersants such as the very low molecular weight sodium polyacrylates, which are known to be useful for the modification of the viscosity and flow properties of mineral slurries, are ineffective.

It is well known that water-absorbent particulate polymeric material absorbs water from its surrounding environment and the use of water-swellable, water-insoluble polymeric materials is known in many fields. For instance, it is known in the production of diapers.

It is also known to include water-absorbent, water-swellable polymers in a growth medium such as sand in order to increase the water absorption capacity of the growth medium, as described in for instance EP 001,253.

Water-absorbent polymers are also known for the treatment of mineral materials in the coal industry. For instance, in our publication EP-A-277,017 we describe the use of absorbent polymeric particles for mixing with sticky coal fines filter cake in order to make a non-sticky, friable fuel. In this process the polymeric particles are blended primarily with coal fines, which tend to have size mainly below 0.5 mm and substantially below 100 $\mu$m. The fines and polymeric particles can also be blended at the same time with coal smalls, which generally have size from 2 to 10 mm. This invention is said to be particularly useful for the production of filter cake which can subsequently be stored or transported by vehicle.

In our publication EP-A-195,550, we describe a more general process in which a slurry or cake is converted to a crumbly state by admixture with water-swellable cross-linked synthetic polymer particles.

EP-A-195,550 is particularly concerned with the problem of a wet particulate mass which must be transported in railway trucks under potentially cold conditions and thus tends to freeze solid in the trucks. The use of polymer particles is said to ensure that the mass remains crumbly within the truck and can be removed easily. The wet particulate mass is preferably mineral ore such as iron ore or coal but can also be sand, china clay, crushed mineral, red mud deposits, or phosphate slime.

EP-A-277,018 describes use of specific water-absorbent polymer particles for conversion of a sticky mass into a crumbly mass, which can be a mass as in EP-A-195,550 above.

However, none of these various publications and known uses of water-absorbent polymers address the problem with which the present invention is concerned, which is the specific problem of the inconsistent materials handling characteristics of raw phosphate rock when it is required to be transferred to a grinding stage.

DETAILED DESCRIPTION OF THE INVENTION

The water-swellable, water-insoluble particulate polymeric material can be a natural polymer such as a gelatinised starch polymer, but is normally wholly synthetic. If synthetic, the polymer is made from water-soluble monomer or monomer blend. The monomers are mainly monoethylenically unsaturated monomers. Cross-linking agent is usually included in order to convert the resultant polymer to water-insoluble but water-swellable form. The cross-linking agent can be reacted into the polymer after polymerisation but preferably is present during polymerisation. Generally the cross-linking agent is a di- or other poly-ethylenically unsaturated monomer such as methylenebisacrylamide (MBA) or any of the other ethylenically unsaturated cross-linking agents that are suitable for cross-linking absorbent polymer. Instead of or in addition to relying on a covalent cross-linking agent of this type, cross-linking can also be through pendant groups in known manner. For instance it can be by means of polyvalent metal ions.

The polymer is generally ionic and is made from 5 to 100 wt % anionic or cationic monomer and 0 to 95 wt % nonionic monomer. The mount of ionic monomer is usually at least 10 wt %. The monomers are generally acrylic, but they can be allylic or other vinyl monomers.

Suitable anionic monomers are ethylenically unsaturated carboxylic or sulphonic monomers such as (meth) acrylic acid, allyl sulphonate or 2-acrylamido methyl propane sulphonic acid (AMPS). Anionic monomers are generally present as a water-soluble salt, usually an alkali metal salt. Sodium salts are especially preferred.

Suitable non-ionic monomers are (meth) acrylamide and $C_{1-4}$ alkyl (meth) acrylic esters, especially hydroxy alkyl esters.

Suitable cationic monomers are dialkyl amino alkyl (meth)-acrylate or acrylamide as the free base, acid salt or, preferably, quaternary salt and diallyl dimethyl ammonium chloride (DADMAC).

Cationic monomers are generally used as a blend with acrylamide. The amount of cationic monomer in the blend is often about 10 to 60 wt %. Anionic monomers may be present as a homopolymer or as copolymers of anionic monomer with, preferably, acrylamide.

With some systems, best results are achieved using cationic polymer alone or blends of cationic polymer with anionic polymer, but it is often preferred to use anionic polymer alone.

The preferred anionic polymers are cross-linked polymers of about 5 to 100 mol % acrylic acid (as free acid or salt) with 0 to 95 mol % acrylamide and optionally 0 to 50 mol % other nonionic or anionic monomer. The acrylic acid is preferably present as sodium salt, i.e., wholly or mainly (e.g., at least 70 or 80% by weight) as sodium acrylate. Suitable polymers are copolymers in which the amount of acrylic acid (as free acid or salt) is typically from about 10 to 20 to 75 wt %, with the balance being acrylamide. It is generally preferred for least 40 wt % of the monomers for the anionic polymer to be sodium acrylate. Typical polymers of this general type are cross-linked polymers of about 40 to 60 wt % sodium acrylate with 60 to 40 wt % acrylamide.

Particularly preferred swellable polymers for use in the invention are homopolymers of the sodium salt of acrylic acid, (although up to 20 wt % of the sodium acrylate can be replaced by acrylamide). Some of the acrylate groups can be in the form of other water-soluble salts, generally other alkali metal salts, or in the form of acrylic acid.

The degree of swellability and adsorption is controlled, in part, by the extent of cross-linking and the amount of cross-linking agent is usually below about 500 ppm, often below 300 ppm. It is usually at least 10 ppm or 20 ppm and preferably at least 50 ppm. Best results are often achieved at around 100 or 200 ppm. These amounts are the amounts (by weight of monomer) of methylene bis acrylamide and equivalent amounts of other cross-linking agents may be used.

The degree of cross-linking, and the polymer type, should be such that the gel capacity of the polymer (grams deionised water absorbed per gram dry polymer) is at least about 25, generally about 25, generally at least 100 and preferably at least 200, typically up to 500 or even 700 or higher.

In some instances it is desirable for the polymer particles to have a surface layer that is less swellable than the inner parts of the particles. The desired reduced swellability of the surface layer is preferably obtained by cross-linking the surface layer. This reduces the content of linear polymer at any position where it might cause stickiness and has the advantage of promoting uptake of water and preventing aggregation of the polymer particles. The desired surface cross-linking can be achieved by methods such as those described in U.S. Pat. Nos. 3,114,651, 3,251,814, 4,043,952, 1,093,013 and 4,090,013, JP 1983/42602 and EP 227,305. Other ways of treating the surface are by applying a coating of a counterionic polymer (e.g., polyDADMAC or other cationic polymer when the swellable polymer is anionic) or by applying sodium aluminate or other aluminate.

The polymer particles can be relatively large, for instance up to 0.5 mm or even 1 mm or up to 2 mm. However, preferably it is desirable for the particles to have a size during the mixing step (when the particles are mixed with the phosphate rock) of below 300 $\mu$m and generally below 200 $\mu$m and preferably at least 90% by weight of the particles have a size during the mixing step below 100 $\mu$m.

The polymer particles can be supplied in the form of individual particles which have the size which is required during the mixing step, or they may be introduced as aggregates of smaller particles, the aggregates having the desired size, or they may be particles of the desired size in the form of larger aggregates.

The particles may be introduced in the form of free powder, for instance polymer gel fines as obtained from the comminution of polymer gel or as fines from a reverse phase bead polymerisation process. Alternatively they can be added in the form of aggregates of fine particles having a size below 50 $\mu$m and often below 30 $\mu$m.

Another way of incorporating the particles, in particular those which have size at least 90 wt % below 100 $\mu$m, is as a dispersion in water immiscible (non-aqueous) liquid. In this case, preferably at least 90% of the particles are below about 20 or 30 $\mu$m, and most preferably below 10 $\mu$m.

The water-immiscible liquid may be any organic liquid in which the polymer particles can be adequately dispersed and that will not interfere with the process and so in practice needs to be non-aqueous. It can be, for instance, a vegetable oil but is preferably a hydrocarbon or halogenated hydrocarbon liquid. It may be selected from any of the liquids conventionally used in reverse phase dispersions. For instance it can be kerosene or diesel oil or other mineral oil.

The dispersion can be formed at the point of use, with the polymer particles being dispersed into the water-immiscible liquid and the mixture then being applied substantially immediately to the raw phosphate rock. Preferably however the dispersion is preformed, in which even it needs to be substantially stable against settlement.

One form of dispersion is a suspension obtained by dispersing preformed dry polymer particles into water-immiscible liquid in the presence of a dispersion stabiliser. The preformed dry polymer particles can be reverse phase microbeads or fines separated from polymer gel, e.g., obtained during the comminution of bulk or bead gel or separated from beads obtained by reverse phase polymerisation.

Instead of using polymer fines, typically having a size of 10 to 30 or 10 to 40 $\mu$m, the dispersion can be a reverse phase dispersion made by reverse phase polymerisation of aqueous monomer or monomer blend in water-immiscible liquid. See for instance U.S. Pat. No. 4,059,552.

The amount of polymer which is applied is usually from 0.05 to 5 wt %, in particular 0.1 to 1 wt % and preferably 0.25 to 0.5 wt % (weight polymer based on weight of phosphate rock).

The phosphate rock which is treated in the invention is a sample which in fact contains a mixture of the rock itself and other materials such as water and contaminants. In this specification, when we refer to "phosphate-containing rock" we mean the mixture which is sent for treatment. This mixture is usually produced by a process which comprises mining the rock and treating it by means of flotation and physical separation processes. The rock is usually not subjected to any treatment stages which lead to substantially drying. In particular it is not subject to fluid bed drying.

The raw phosphate rock generally contains from 3 to 25 wt % water (weight water based on total weight of the phosphate rock mixture). Preferably it contains from 5 to 8 wt % moisture.

The phosphate rock may also contain contaminants and we have found that surprisingly the process is particularly effective in circumstances where the phosphate rock also comprises contaminants including clay, limestone and/or magnesium-containing contaminants, in particular clay.

We find it particularly surprising that the water-swellable, water-insoluble polymers, which are well known as water-absorbents, are especially effective in systems which contain such contaminants as well as water.

The process can be any process in which phosphate rock containing the specified amount of moisture is treated by a process which comprises a grinding stage. Such processes include the production of ammonium phosphate (used for fire prevention), production of fertilisers and production of phosphoric acid. The preferred process is the granular super triple phosphate (GSTP) process. In this process the phosphate rock is ground and added to an agitated reaction vessel containing phosphoric acid which has been made using any one of several known "wet process" methods.

Processes in which the invention is especially useful are those which are carried out on plants which require consistent flow and viscosity properties from the phosphate rock. Such plants are generally designed to treat phosphate rock which has been pretreated by drying and does not give rise to the problems which arise with rock containing 3 to 25 wt % moisture.

In such plants the phosphate rock, which has been treated using traditional flotation and physical separation methods is brought to the plant and conveyed to a bucket elevator, usually via a conveyor. The phosphate rock is raised in the bucket elevator to an elevated storage vessel. After entry to the storage vessel the rock may remain there for at least 30 minutes, often up to several (eg 3, 5 or 10) hours. It is then transferred to the grinding apparatus (often described as a grinding mill) along ducts or pipes or other conduits which rely on gravity as the transfer force. Without use of the invention the flowability of the rock along these conduits is inconsistent, and the inconsistent flow to the grinding mill leads to excessive wear on grinding surfaces and production losses. Phosphate rock which has been pretreated using fluid bed drying tends not to give rise to such viscosity and flowability problems.

In the invention the water-swellable water-insoluble polymer particles are added to the phosphate rock and mixed with it during the transfer stage, i.e. after arrival of the phosphate rock at the plant and before the grinding stage. Generally mixing occurs before any part of the transfer stage which requires passage of the phosphate rock along a conduit in which gravity is the transfer force. For instance, in a process such as that described above the polymer particles and phosphate rock are mixed before the rock reaches the storage vessel, for instance in the bucket elevator. Alternatively the phosphate rock and polymer particles may be mixed as the phosphate rock is transferred to the bucket elevator on a conveyor.

The phosphate rock which is supplied to the transfer stage normally has a size of 35×150 mesh. Size is measured in terms of the maximum diameter of the particles of rock. The following is an example of the invention.

Phosphate rock produced locally in Florida by conventional beneficiation techniques is loaded into 100 ton rail cars and transported to the phosphoric acid plant where it is converted into a variety of intermediate and finished products. One of these products is granular triple super phosphate or GTSP. GTSP is produced by reacting finely ground (50% passing 100 mesh) phosphate rock with wet process phosphoric acid at elevated temperatures (180–200° F.).

The rock in the rail cars is unloaded at a rate of about 1 ton per minute. The water-swellable superabsorbent polymer previously described is added to the rock unloading conveyor as the rail car is unloaded. The polymer/rock mixture is conveyed to a bucket elevator which both mixes and transports the rock/polymer mixture to a large holding vessel. The rock/polymer mixture is held in this vessel for approximately 1 hour before gravity conveyance to a "Raymond" type roller grinding mill. Prior to this invention, the Raymond mills experienced approximately 50% down time and maintenance costs in excess of US$ 60,000/month. Following the introduction of this invention into the process, the operating factor routinely exceeds 80% and maintenance costs have reduced by a factor of 4.

What is claimed is:

1. A process of treating phosphate-containing rock by grinding, the process comprising providing phosphate-containing rock in a form which contains from 3 to 25 wt % water, transferring the phosphate-containing rock to a grinding apparatus during a transfer stage, and grinding the phosphate-containing rock in grinding apparatus, wherein the process comprises mixing with the phosphate-containing rock during or before the transfer stage particles of water-swellable, water-insoluble polymeric material, whereby the flowability of the rock into the grinding apparatus is improved.

2. A process according to claim 1 in which the phosphate-containing rock is provided in a form which contains with contaminants selected from the group consisting of claims, limestone and magnesium compounds.

3. A process according to claim 1 in which the phosphate-containing rock has been produced by mining, flotation and physical separation and substantially without a drying stage.

4. A process according to claim 1 in which the amount of polymeric material mixed with the phosphate-containing rock is mixed in an amount of from 0.25 to 0.5 wt % based on the weight of the rock.

5. A process according to claim 1 in which the polymeric materials is provided in the form of particles having size at least 90% by weight below 50 $\mu$m.

6. A process according to claim 1 which is a process of producing granular triple super phosphate in which the phosphate-containing rock is subjected to the grinding stage in the presence of phosphoric acid.

7. A process according to claim 1 in which the transfer stage is carried out by means of apparatus comprising pipes or ducts.

* * * * *